US010392222B2

(12) United States Patent
Simcik et al.

(10) Patent No.: US 10,392,222 B2
(45) Date of Patent: Aug. 27, 2019

(54) ELEVATOR REMOTE DESTINATION ENTRY BASED ON ALTITUDE

(71) Applicant: Otis Elevator Company, Farmington, CT (US)

(72) Inventors: Paul A. Simcik, Southington, CT (US); Bradley Armand Scoville, Farmington, CT (US); Eric C. Peterson, East Longmeadow, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 431 days.

(21) Appl. No.: 15/032,246

(22) PCT Filed: Oct. 28, 2013

(86) PCT No.: PCT/US2013/067067
§ 371 (c)(1),
(2) Date: Apr. 26, 2016

(87) PCT Pub. No.: WO2015/065315
PCT Pub. Date: May 7, 2015

(65) Prior Publication Data
US 2016/0272460 A1 Sep. 22, 2016

(51) Int. Cl.
*B66B 1/34* (2006.01)
*B66B 1/46* (2006.01)

(52) U.S. Cl.
CPC ..... *B66B 1/468* (2013.01); *B66B 2201/4615* (2013.01); *B66B 2201/4653* (2013.01)

(58) Field of Classification Search
CPC ..... B66B 1/468; B66B 2201/4615; B66B 2201/4638; B66B 2201/4653
USPC ..... 187/247, 277, 380–388, 391, 392, 393, 187/394, 396
See application file for complete search history.

(56) References Cited

U.S. PATENT DOCUMENTS 4,874,063 A 10/1989 Taylor
6,382,363 B1 * 5/2002 Friedli ..... B66B 1/468 187/384
6,397,976 B1 * 6/2002 Hale ..... B66B 1/468 187/384
(Continued)

FOREIGN PATENT DOCUMENTS

CN 1492831 A 4/2004
CN 101955093 A 1/2011
(Continued)

OTHER PUBLICATIONS

Chinese First OA and Search Report for application CN 201380080578.6, dated May 27, 2017, 18pgs.
(Continued)

*Primary Examiner* — Anthony J Salata
(74) *Attorney, Agent, or Firm* — Cantor Colburn LLP

(57) ABSTRACT

A method includes determining an altitude of a mobile device, determining a floor coinciding with the altitude, and requesting elevator service specific to the floor mapped to the mobile device location. An apparatus includes a memory having instructions stored thereon that, when executed, cause the apparatus to: determine an altitude of the apparatus within a building, determine a floor within the building coinciding with the altitude, and request an elevator car to arrive at the floor.

19 Claims, 2 Drawing Sheets

(56) References Cited

U.S. PATENT DOCUMENTS

| | | | | |
|---|---|---|---|---|
| 6,833,811 | B2 | 12/2004 | Zeitfuss et al. | |
| 6,868,945 | B2 | 3/2005 | Schuster et al. | |
| 7,484,598 | B2 * | 2/2009 | Tyni | B66B 5/0025 187/291 |
| 7,496,445 | B2 * | 2/2009 | Mohsini | G01C 21/20 340/944 |
| 8,151,942 | B2 * | 4/2012 | Rusanen | B66B 1/468 187/247 |
| 8,348,018 | B2 * | 1/2013 | Kostka | B66B 3/02 187/249 |
| 8,540,057 | B2 * | 9/2013 | Schuster | B66B 1/34 187/247 |
| 8,763,762 | B2 * | 7/2014 | Finschi | B66B 1/468 187/391 |
| 8,905,195 | B2 * | 12/2014 | Finschi | B66B 1/2458 187/249 |
| 8,915,334 | B2 * | 12/2014 | Finschi | B66B 1/2408 187/384 |
| 9,323,232 | B2 * | 4/2016 | Blom | H04W 4/029 |
| 10,118,797 | B2 * | 11/2018 | Keser | B66B 1/468 |
| 2008/0234928 | A1 | 9/2008 | Matsuoka | |
| 2011/0200023 | A1 | 8/2011 | Murray et al. | |
| 2012/0000733 | A1 | 1/2012 | Finschi | |
| 2015/0249907 | A1 * | 9/2015 | Gupta | H04W 4/043 455/456.1 |
| 2016/0031676 | A1 * | 2/2016 | Haipus | B66B 1/468 187/247 |
| 2017/0137255 | A1 * | 5/2017 | Simcik | B32B 27/306 |
| 2017/0225921 | A1 * | 8/2017 | Scoville | B66B 1/468 |

FOREIGN PATENT DOCUMENTS

| | | | |
|---|---|---|---|
| CN | 102164343 | A | 8/2011 |
| KR | 1020110096269 | A | 8/2011 |
| WO | 0266357 | A1 | 8/2002 |
| WO | 2011102564 | A1 | 8/2011 |
| WO | 2012130729 | A1 | 10/2012 |

OTHER PUBLICATIONS

EP Search Report for EP13896758.3, dated May 22, 2017, 6pgs.

Bernstein, Ron, "Smart Buildings and the Smart Grid", available at http://www.lonmark.org/presentations/2012/Q3/2012-09+Smart+Buildings+and+Smart+Grid--RBCG.pdf, accessed Apr. 26, 2016, www.rb-cg.com, 31 pages.

International Search Report and Written Opinion for application PCT/US2013/067067, dated Jul. 21, 2014, 14 pages.

Kaplan, Melanie D. G., "Intelligent elevators answer vertical challenges", SmartPlanet, Jul. 12, 2012, 5 pages.

Moreno, Jorge, "Intelligent Enterprise Platform—Connecting Devices to the Enterprise", available at http://www.esmagazine.com/ext/resources/ES/Home/Files/PDFs/1104Tridium.pdf, accessed Apr. 26, 2016, Frost and Sullivan, 16 pages.

Olear, Greg, "Smart Buildings, Smart Boards", available at http://cooperator.com/articles/2512/1/Smart-Buildings-Smart-Boards/Page1.html, accessed Sep. 10, 2013, 3 pages.

Stack Overflow, "How accurate is the altitude measurement in mobile phones?", http://stackoverflow.com/questions/5825829/how-accurate-is-the-altitude-measurement-in-mobile-phones, accessed Oct. 2, 2013, 2 pages.

* cited by examiner

ELEVATOR REMOTE DESTINATION ENTRY BASED ON ALTITUDE

BACKGROUND

Existing destination dispatching systems require a mechanism of determining passenger location. This may be provided by the use of hard-wired destination entry devices, such as touch screen kiosks, which have a known and fixed physical location.

As technology advances, the use of wireless and mobile devices to request destination dispatching services is a possibility. However, such entry is prone to error. For example, a passenger of an elevator system may mistakenly indicate on her cell phone that she is located on the fourth floor of a building, when in reality she is on the seventh floor of the building. In yet another illustrative scenario, a second passenger requesting elevator service may intentionally indicate an incorrect floor number for his current location within a building, motivated perhaps out of spite for an owner of the building or a tenant located in the building.

BRIEF SUMMARY

An embodiment is directed to a method comprising: determining an altitude of a mobile device, determining a floor coinciding with the altitude, and requesting elevator service specific to the floor mapped to the mobile device location.

An embodiment is directed to an apparatus comprising: memory having instructions stored thereon that, when executed, cause the apparatus to: determine an altitude of the apparatus within a building, determine a floor within the building coinciding with the altitude, and request an elevator car to arrive at the floor.

An embodiment is directed to an apparatus comprising: memory having instructions stored thereon that, when executed, cause the apparatus to: receive from a mobile device an indication of a current altitude of the mobile device within a building, determine a floor within the building coinciding with the altitude, and dispatch an elevator car to the floor.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
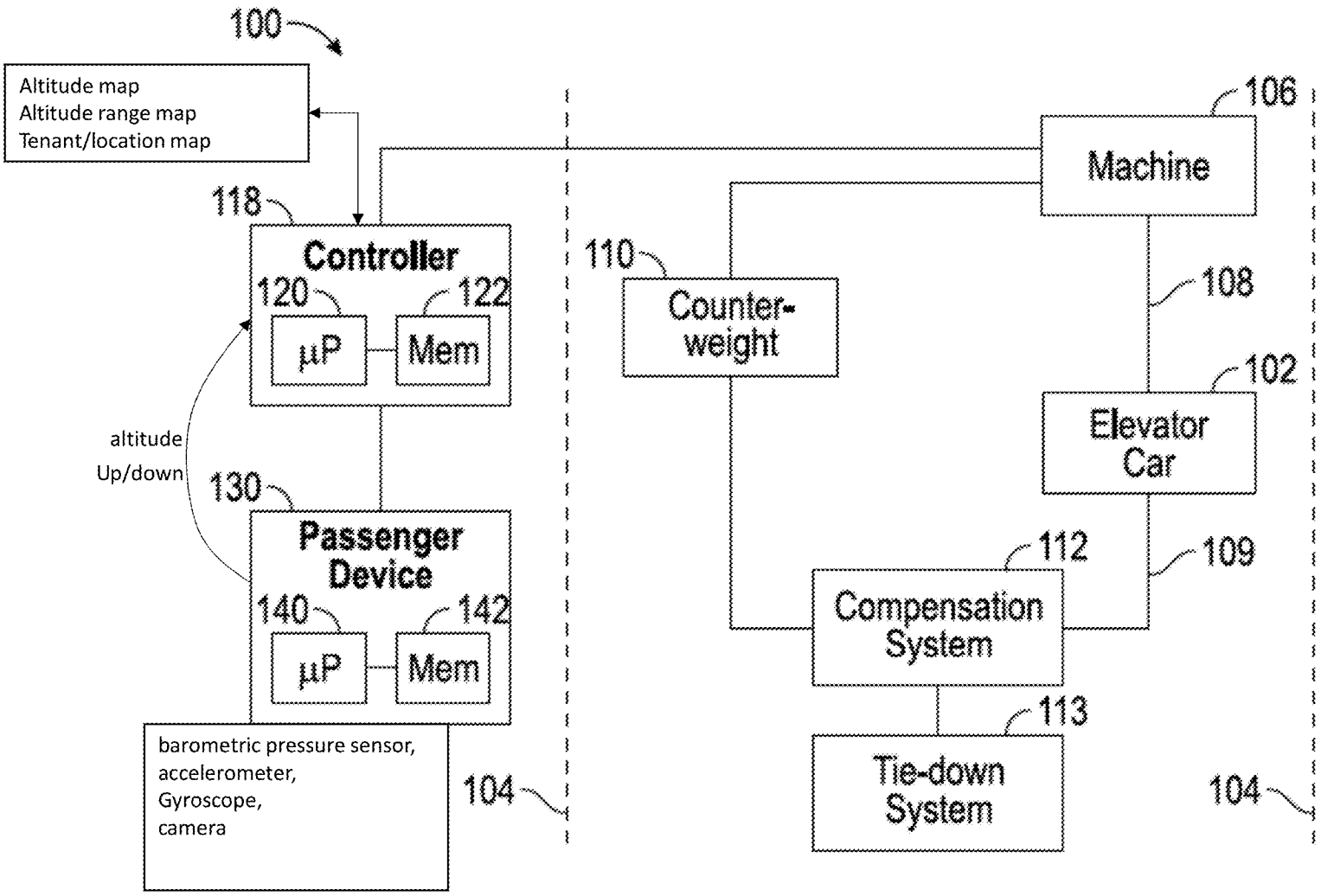
FIG. 1 illustrates an exemplary elevator system in accordance with one or more embodiments of the disclosure.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this respect, a coupling between entities may refer to either a direct or an indirect connection.

Exemplary embodiments of apparatuses, systems and methods are described for providing a seamless, error-free entry of dispatch requests in an elevator system. Such features may be particularly suitable in embodiments where a floor number is non-obvious or ambiguous (e.g., M2).

Embodiments of the disclosure provide a capability of wireless entry of destinations in an elevator system. In some embodiments, a current position or location of a passenger issuing a dispatch request may be determined. Such a position may be determined at least partially in terms of altitude. In some embodiments, the position may be determined based on a device associated with the passenger.

FIG. 1 illustrates a block diagram of an exemplary elevator system 100 in accordance with one or more embodiments. The organization and arrangement of the various components and devices shown and described below in connection with the elevator system 100 is illustrative. In some embodiments, the components or devices may be arranged in a manner or sequence that is different from what is shown in FIG. 1. In some embodiments, one or more of the devices or components may be optional. In some embodiments, one or more additional components or devices not shown may be included.

The system 100 may include one or more elevator cars 102 that may be used to convey, e.g., people or items up or down an elevator shaft or hoist-way 104.

The elevator car 102 may be coupled to a machine 106, potentially via one or more hoist ropes or cables 108. The machine 106 may be associated with one or more motors, pulleys, gearboxes and/or sheaves as would be known to one of skill in the art to facilitate the movement or hoisting of the elevator car 102 within the system 100.

In some embodiments, the machine 106 may be coupled to one or more counterweights 110. The counterweight 110 may serve to balance the weight associated with one or more of the elevator cars 102.

The counterweight 110 may be coupled to the elevator car 102 via one or more compensation systems 112. The compensation system 112 may include one or more of: ropes or cables, pulleys, weights, and a tie-down sheave. The compensation ropes/cables may be used to control the elevator and may compensate for differing weight of hoist ropes/cables 108 between the elevator car 102 and the top of the hoist-way 104. For example, if the elevator car 102 is located towards the top of the hoist-way 104, then there may exist a short length of hoist ropes/cables 108 above the elevator car 102 and a long length of compensating ropes/cables below the elevator cars 102. Similarly, if the elevator car 102 is located towards the bottom of the hoist-way 104, then there may exist a long length of hoist ropes/cables 108 above the elevator car 102 and a short length of compensating ropes/cables below the elevator car 102.

The compensation system 112 may be coupled to a tie-down system 113. The tie-down system 113 is a device that ensures forces in the hoist ropes/cables 108 and compensation ropes/cables 109 are controlled during safety and/or brake operations in the system 100.

The system 100 may include a controller 118. In some embodiments, the controller 118 may include at least one processor 120, and memory 122 having instructions stored thereon that, when executed by the at least one processor 120, cause the controller 118 to perform one or more acts, such as those described herein. In some embodiments, the processor 120 may be at least partially implemented as a microprocessor (uP). In some embodiments, the memory 122 may be configured to store data. Such data may include data associated with one or more elevator cars 102, selected destinations for the elevator cars 102, etc.

Also shown in the system 100 is a passenger device 130. The device 130 may correspond to a device that is typically in the possession of a passenger of the elevator system 100, such as a mobile device (e.g., a cell phone or smartphone or tablet), a laptop computer, etc. The device 130 may be wirelessly communicatively coupled to one or more entities, such as the controller 118. The device 130 may include at least one processor 140 and memory 142. The memory 142 may have instructions stored thereon that, when executed by the at least one processor 140, cause the device 130 to perform one or more acts, such as those described herein.

The device 130 may be configured to support dispatching operations. A current location of a passenger associated with the device 130 may be determined using one or more techniques. For example, the device 130 may include one or more devices or components that are configured to determine an altitude within a building in which the system 100 is located. Such components or devices may include a barometric pressure sensor, a global positioning system (GPS) sensor, an accelerometer, a gyroscope, near field communication (NFC), radio-frequency identification (RFID), or other RF signal strength indications, a camera, etc. In terms of the use of a camera, if one or more features (e.g., a pattern of a carpet) distinguish a current floor or location within the building from the other floors or locations, a picture of or machine readable code located in the surrounding scene may be used to determine a current location/floor of the device 130.

In some embodiments, the device 130 may be provided a file that maps altitude (or range of altitude values to account for noise or variations in the device 130) to a floor number or level. In this manner, the device 130 may determine its current altitude and translate that current altitude to a current floor number or level. The device 130 may then provide or transmit the current floor number or level as determined by the device 130 to, e.g., the controller 118 for purposes of requesting elevator service (e.g., for purposes of conveying the elevator car 102 to receive the passenger at the passenger's current location). Such techniques may also be used to provide an indication of the current floor/level on the device 130. Thus, if the passenger is traversing the hoistway 104 and is in a crowded elevator car 102, the passenger might only need to look at her device 130 to obtain an indication as to her location (e.g., floor number).

In some embodiments, the device 130 may provide or transmit the current altitude information to the controller 118, and the controller 118 may be responsible for mapping the altitude to the current floor/level of the passenger. Such embodiments may be used to simplify or streamline the operation of the device 130 by placing more of the intelligence in the controller 118.

Figure 2:
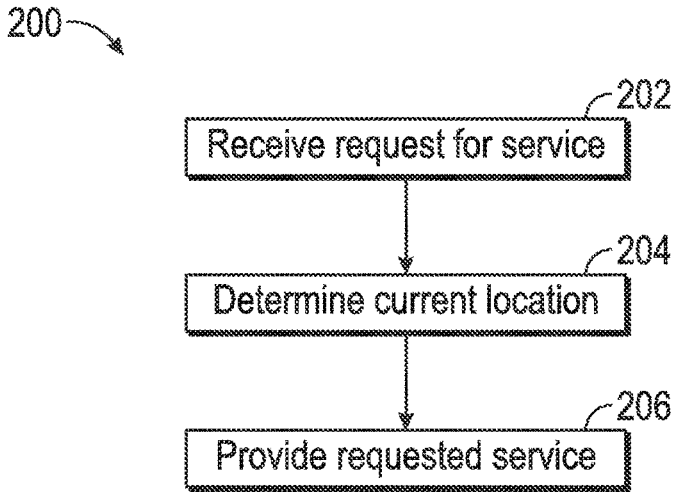
FIG. 2 illustrates a flow chart of an exemplary method in accordance with one or more embodiments of the disclosure.

Turning now to FIG. 2, a flow chart of an exemplary method 200 is shown. The method 200 may be used to facilitate dispatching operations in connection with one or more systems, such as the system 100.

In block 202, a request for service may be received. For example, a passenger of an elevator system may input on, e.g., a mobile device, that elevator service is requested. In some instances, the request for service may include a specification of a destination in other cases it may only specify an up or down direction or request specialized services (e.g. VIP mode). The destination may be specified as a floor number or level (e.g., floor #9). Alternatively, the destination may be specified as, e.g., an office or tenant within the building (e.g., Dentist Office X) that the passenger wants to visit, and a directory or mapping (located at, e.g., the device 130 or the controller 118) may be used to translate the specified office/tenant to a floor number or level on which the office/tenant is located.

In block 204, a determination of the passenger's current location may be provided. The current location may be specified in one or more terms. For example, the passenger's current location may be based on an altitude measurement conducted by, e.g., the device 130. The altitude measurement may be translated or mapped (by, e.g., the device 130 or the controller 118) to a floor number or level within a building.

In block 206, an elevator car may be dispatched to pick up the passenger at the passengers current location, e.g., a floor of origin, in order to convey the passenger to a selected destination (if specified).

The method 200 is illustrative. In some embodiments, one or more of the blocks or operations (or portions thereof) may be optional. In some embodiments, the operations may execute in an order or sequence different from what is shown. In some embodiments, one or more additional operations not shown may be included.

In some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory having instructions stored thereon that, when executed by the one or more processors, cause the apparatus or system to perform one or more methodological acts as described herein. In some embodiments, digital logic (e.g., programmable logic, such as a CPLD, FPGA, etc.) may be used. In some embodiments, one or more input/output (I/O) interfaces may be coupled to one or more processors and may be used to provide a user with an interface to an elevator system. Various mechanical components known to those of skill in the art may be used in some embodiments.

Embodiments may be implemented as one or more apparatuses, systems, and/or methods. In some embodiments, instructions may be stored on one or more computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A method comprising:

determining an altitude of a mobile device;

determining a floor coinciding with the altitude; and requesting elevator service specific to the floor;

wherein the altitude is determined based on the use of at least one of a barometric pressure sensor, an accelerometer, a gyroscope and a camera included in the mobile device.

2. The method of claim 1, further comprising:

receiving a request for elevator service, wherein the altitude of the mobile device is determined in response to the request for elevator service.

3. The method of claim 2, wherein the received request for elevator service comprises an up/down direction request.

4. The method of claim 2, wherein the received request for elevator service comprises a specification of a destination, and wherein the elevator car traverses a hoist-way from the floor within the building coinciding with the altitude to a destination floor associated with the specified destination.

5. The method of claim 4, wherein the destination is specified as at least one of an office and a tenant located in the building, the method further comprising:

mapping the at least one of an office and a tenant to the destination floor.

6. The method of claim 1, further comprising:

transmitting, by the mobile device, the altitude to a controller, wherein the controller determines the floor within the building coinciding with the altitude.

7. The method of claim 1, wherein the mobile device determines the floor within the building coinciding with the altitude.

8. The method of claim 1, wherein the floor within the building coinciding with the altitude is determined based on the altitude falling within a range of altitude values assigned to the floor.

9. An apparatus comprising:

memory having instructions stored thereon that, when executed, cause the apparatus to:

receive a request for elevator service, determine an altitude of the apparatus within a building;

determine a floor within the building coinciding with the altitude; and request an elevator car to arrive at the floor;

wherein the altitude of the apparatus is determined in response to the request for elevator service;

wherein the apparatus is configured to determine the altitude of the apparatus based on the use of at least one of a barometric pressure sensor, an accelerometer, a gyroscope and a camera included in the apparatus.

10. The apparatus of claim 9, wherein the received request for elevator service comprises a specification of a destination, and wherein the request for elevator service comprises a request for the elevator car to traverse a hoist-way from the floor within the building coinciding with the altitude to a destination floor associated with the specified destination.

11. The apparatus of claim 10, wherein the destination is specified as at least one of an office and a tenant located in the building, and wherein the instructions, when executed, cause the apparatus to:

map the at least one of an office and a tenant to the destination floor.

12. The apparatus of claim 9, wherein the instructions, when executed, cause the apparatus to:

receive a map used to translate between altitude and floors within the building; and determine the floor within the building coinciding with the altitude based on the map.

13. The apparatus of claim 9, wherein the instructions, when executed, cause the apparatus to:

determine the floor within the building coinciding with the altitude based on the altitude falling within a range of altitude values assigned to the floor.

14. The apparatus of claim 9, wherein the instructions, when executed, cause the apparatus to:

determine a second altitude of the apparatus within the building as the apparatus and the elevator car traverse a hoist-way;

determine a second floor within the building coinciding with the second altitude; and present an indication of the second floor.

15. An apparatus comprising:

memory having instructions stored thereon that, when executed, cause the apparatus to:

receive a request for elevator service, receive from a mobile device an indication of a current altitude of the mobile device within a building, determine a floor within the building coinciding with the altitude, and dispatch an elevator car to the floor;

wherein the altitude of the mobile device is received in response to the request for elevator service;

wherein the apparatus is configured to determine the altitude of the apparatus based on the use of at least one of a barometric pressure sensor, an accelerometer, a gyroscope and a camera included in the apparatus.

16. The apparatus of claim 15, wherein the instructions, when executed, cause the apparatus to:

determine the floor based on the altitude falling within a range of altitude values assigned to the floor.

17. The method of claim 1, wherein the altitude is determined based on the use of at least one of the barometric pressure sensor and the camera included in the mobile device.

18. The apparatus of claim 9, wherein the apparatus is configured to determine the altitude of the apparatus based on the use of at least one of the barometric pressure sensor and the camera included in the apparatus.

19. The apparatus of claim 15, wherein the apparatus is configured to determine the altitude of the apparatus based on the use of at least one of the barometric pressure sensor and the camera included in the apparatus.

* * * * *